US009433277B2

(12) United States Patent
Gafni

(10) Patent No.: US 9,433,277 B2
(45) Date of Patent: Sep. 6, 2016

(54) EYEBROW SCULPTING TEMPLATE AND METHOD

(71) Applicant: RAMY COSMETICS, LLC, New York, NY (US)

(72) Inventor: Ramy Gafni, New York, NY (US)

(73) Assignee: Ramy Cosmetics, LLC, New York, NY (US)

( * ) Notice: Subject to any disclaimer, the term of this patent is extended or adjusted under 35 U.S.C. 154(b) by 0 days.

(21) Appl. No.: 14/525,699

(22) Filed: Oct. 28, 2014

(65) Prior Publication Data

US 2015/0114420 A1 Apr. 30, 2015

Related U.S. Application Data

(60) Provisional application No. 61/897,882, filed on Oct. 31, 2013.

(51) Int. Cl.
*A45D 40/30* (2006.01)

(52) U.S. Cl.
CPC ..... *A45D 40/30* (2013.01); *A45D 2200/25* (2013.01)

(58) Field of Classification Search
CPC .. A45D 27/42; A45D 40/30; A45D 2200/25; A45D 44/00; A45D 44/002; A45D 44/12; A45D 26/00
USPC ..... 132/319, 216, 218, 320, 285
See application file for complete search history.

(56) References Cited

U.S. PATENT DOCUMENTS

| | | | | | |
|---|---|---|---|---|---|
| 2,435,516 | A * | 2/1948 | Samson | A45D 40/30 | 101/128 |
| 3,300,864 | A * | 1/1967 | Lesslie | A61B 5/107 | 132/216 |
| 4,118,870 | A * | 10/1978 | Dyson | A45D 40/30 | 33/512 |
| 5,186,190 | A | 2/1993 | Hirzel | | |
| 5,662,129 | A * | 9/1997 | Grenevitch | A45D 40/30 | 132/216 |
| 5,860,433 | A | 1/1999 | Halpern | | |
| 6,336,462 | B1 | 1/2002 | Santelli et al. | | |
| 7,219,674 | B1 | 5/2007 | Shelley | | |

(Continued)

FOREIGN PATENT DOCUMENTS

| | | |
|---|---|---|
| CN | 2482331 Y | 3/2002 |
| JP | H10108730 A | 4/1998 |
| JP | 2002291530 | 10/2002 |

OTHER PUBLICATIONS

PCT/US2014/062608; International Search Report and Written Opinion; Jan. 22, 2015 (7 pgs).

*Primary Examiner* — Tatiana Nobrega
(74) *Attorney, Agent, or Firm* — Gearhart Law LLC

(57) ABSTRACT

An adjustable eyebrow template has at least a first template and a second template. Each of the templates has a cut out that is shaped substantially like an eyebrow. By sliding the second template within at least one slot present on the first template, the shape of the cutout can be modified via overlaying of the templates. The modified eyebrow shape can then be colored, stenciled, etc. If desired, excess hair can then be removed from the eyebrow by a variety of common hair removal techniques. Additionally, there is a method for using the adjustable eyebrow template as to enable an individual to easily create symmetrical eyebrow shapes and colors on a recipient. This method can be performed by a sole individual or with the help of another. An eyebrow template kit may have a number of templates, a coloring agent, and a brush for application of the coloring agent.

8 Claims, 5 Drawing Sheets

(56) References Cited

U.S. PATENT DOCUMENTS

| | | | | |
|---|---|---|---|---|
| 7,322,991 | B1 | 1/2008 | Robinson | |
| 7,334,586 | B2 | 2/2008 | Pilmanis | |
| 8,051,860 | B1 | 11/2011 | Pereira | |
| 8,997,757 | B1 * | 4/2015 | Soare | A45D 26/00 132/200 |
| 2003/0234028 | A1 * | 12/2003 | Edell | A45D 40/30 132/319 |
| 2004/0231694 | A1 | 11/2004 | Rosenblatt | |
| 2006/0249173 | A1 * | 11/2006 | Lawson | A45D 40/30 132/319 |
| 2006/0254608 | A1 | 11/2006 | Lam | |
| 2007/0006748 | A1 * | 1/2007 | Liu | A45D 40/30 101/127 |
| 2008/0276953 | A1 | 11/2008 | McGee | |
| 2009/0151741 | A1 | 6/2009 | Ngo | |
| 2009/0183750 | A1 | 7/2009 | Platt-Gregory | |
| 2010/0229886 | A1 | 9/2010 | Plain | |
| 2012/0197268 | A1 | 8/2012 | Tran | |
| 2012/0222694 | A1 | 9/2012 | Soare | |
| 2013/0263885 | A1 * | 10/2013 | Sternad | A45D 40/30 132/319 |

* cited by examiner

EYEBROW SCULPTING TEMPLATE AND METHOD

CLAIM OF PRIORITY

This application claims priority U.S. application Ser. No. 61/897,882 filed on Oct. 31, 2013, the contents of which are herein fully incorporated by reference in its entirety.

FIELD OF THE INVENTION

The field of the invention relates to eyebrow shaping templates, namely adjustable templates. In particular, the present invention provides for adjustable eyebrow templates to easily and effectively mark dimensions of the eyebrow area to be treated and facilitate removal of unwanted eyebrow hair.

BACKGROUND OF THE INVENTION

It is not uncommon for people, especially women, to modify the appearance of their eyebrows. Eyebrow modification is typically done through the use of tattoos, coloring, piercings, makeup, and shaping (removal of eyebrow hairs). The predominant method employed is shaping, and these hair removal methods may include hair removal creams, tweezers, lasers, scissors, waxing, and threading. Each of these methodologies has its advantages, but some flaws are inherent across the board given the present state of the technology.

Studies have shown that beauty, as perceived by others, is predominantly determined by the symmetry present in one's physical features, namely their facial structure. In order to bolster their physical appearance many individuals shape their own eyebrows to enhance their facial features and desire to do so symmetrically. However, it is often difficult to make the eyebrows symmetrical, and attempts to match one brow to the other often results in over plucked and irregularly shaped brows.

There are a number of eyebrow templates on the market that attempt to rectify this shortcoming. These templates are generally uniform in shape and do not take an individual's face shape into account. This creates shaped eyebrows that do not match the facial features of the individual. In order to consistently create the ideal brow shape given the state of the current technology, one would need a vast array of different shaped and sized templates. Additionally, some templates are attached to the individual and use adherence means such as headbands to secure the device to the individual. The headband type devices can be uncomfortable to wear and will interfere with a person's hairstyle.

Review of Related Technology:

U.S. Pat. No. 7,322,991 pertains to an eyebrow shaping device for shaping eyebrows. The eyebrow shaping device includes a plurality of pairs of forms defining various shapes and sizes of eyebrows. Each pair of forms comprises a right and a left template. Each form has a template portion with a cut-out defining the shape and size, a substrate portion distributed along a first surface of the template portion and designed for removing unwanted eyebrow hair, and a protective portion releasably coupled to the substrate portion for protecting the substrate portion until use.

U.S. Pat. No. 7,219,674 pertains to an eyebrow template that can be used to apply makeup to a person's eyebrows. The template has a saddle that is shaped to be placed against the bridge of the person's nose. The template also has a pair of guides each attached to the saddle and each having a guide opening for guiding the application of makeup to the person's eyebrows. After placing the saddle against the bridge of the person's nose the templates are adjusted to outline the person's eyebrows. Then makeup is applied to the person's eyebrows using the templates to guide the makeup application.

U.S. Pat. No. 6,336,462 pertains to a template that may be formed from an adhesive such as surgical tape, having an opening cut therein in the shape of an eyebrow. The template may have a low-tack adhesive coating on one side, or a depilatory coating, or one of each on both sides of the substrate. When used for eyebrow shaping, the adhesive side is adhered to the skin, and coloring is applied through the opening. When used for waxing, the depilatory coating is applied to the region around the shape of the eyebrow to be left after the depilation procedure. The depilatory coating may be a heat-activated composition, or a pressure-activated composition. The templates may be provided in pairs, in rolls of groups of pairs.

U.S. Pat. No. 5,662,129 pertains to an eyebrow template system which enables the user to symmetrically or asymmetrically shape eyebrows to yield aesthetically pleasing shape and size. The system includes a pair of templates having openings in the desired shape of the simulated eyebrow. A template holder receives each of the pair of templates through a pair of slots, each slot receiving one of the templates. The template holder also is formed with a pair of apertures generally larger than the openings of the pair of templates to enable a user to paint the simulated eyebrows. A fastener then attaches the apparatus for applying simulated eyebrows to the user.

U.S. Patent Application 2007/0006748 pertains to a stencil strap for eyebrow-stenciling. The strap comprises a strap body having two ends mounted with a male and female adhesive plate, and a central upper and lower edge provided with an eyebrow center and nose positioning plate, wherein the two lateral sides of the positioning plate are respectively provided with elongated opening and the upper and lower edge of the opening are provided with a plurality of engaging hooks; and a plurality of stencils having a circumferential edge provided with a stepped section, the stepped section being mounted with fastening hole corresponding to the engaging hooks of the strap body, wherein the surface of the stencil is stenciling opening of various shapes.

Thus, various devices are known in the art. However, their structure and means of operation are substantially different from the present disclosure. The stencils or templates do not provide for a wide range of flexibility in the size or shape of the template. Different templates must be either interchanged or used separately. Other devices require the user to hold the device to their face with one hand, whilst using their other hand to modify their brow.

In short, the other inventions all fail to solve all the problems taught by the present disclosure. The present invention provides an adjustable template that can create virtually any shaped brow quickly and easily. The shape can then be used on each brow without fear of losing the particular desired shape. At least one embodiment of this invention is presented in the drawings below and will be described in more detail herein.

SUMMARY OF THE INVENTION

An adjustable eyebrow template is described and taught for defining and/or coloring a desired shape of an eyebrow having a first template having an upper surface and a lower surface, the upper surface being coupled to the lower surface, wherein the upper surface has a first outer perimeter and a first inner perimeter, wherein the lower surface has an identical inner perimeter as the upper surface; a second template having a second outer perimeter and a second inner perimeter, wherein the second inner perimeter is similar in shape to the inner perimeter of the first template; and wherein the first inner perimeter and the second inner perimeter substantially correspond to the shape of an eyebrow.

In another embodiment of the present invention there is an adjustable eyebrow template for defining and coloring a desired shape of an eyebrow having a first template having an upper surface and a lower surface, the upper surface being coupled to the lower surface, wherein the upper surface and the lower surface have an identical inner perimeter, wherein the upper surface has at least one first alignment indicia; a second template having a second outer perimeter and a second inner perimeter, wherein the second inner perimeter is similar in shape to the inner perimeter of the first template, wherein the second template has at least one second alignment indicia; and wherein the first inner perimeter and the second inner perimeter substantially correspond to the shape of an eyebrow.

The two templates are generally polygonal in shape and contain an inner perimeter that is substantially shaped like an eyebrow. The inner perimeter of the second template is similar in shape to the first template. The second template is designed to fit into a slot(s) in the first template. The first template has an upper and a lower surface joined together along at least one point of the template structure. This provides for a narrow slot(s) that allows the second template to be inserted and slidably positional within the first template.

Once inserted, the shape of the second template's inner perimeter is used to modify the shape of the inner perimeter of the first template. This can be used to create an extensive variety of eyebrow shapes and sizes. The templates can be used to change the thickness, thinness, width, or length of one's eyebrow. Ideally, there is at least one slot in the first template to give the widest range of flexibility, however, there may be more slots incorporated into the design. The dimensions of the slot should provide for a frictionable interaction between the two templates. This may permit the templates to hold the desired position and shape once removed or when manipulating the template to fit over the second eyebrow. Additionally, a low tack adhesive or a clip structure may be used to secure the templates to one another. The templates should generally be formed from a flexible, non-reactive plastic.

In another aspect of the invention there is a method of shaping eyebrows using an adjustable eyebrow template achieved by aligning a first template having a first outer perimeter and a first inner perimeter over the eyebrow, wherein the inner perimeter substantially corresponds to the shape of an eyebrow; aligning a second template having a second outer perimeter and a second inner perimeter with the first template thereby modifying the shape of the inner perimeter of the first template to a modified perimeter; marking an area of the eyebrow within the modified perimeter with a coloring agent; removing the template from the eyebrow leaving a colored, shaped eyebrow; and removing excess hair outside of the colored, shaped eyebrow.

The method may further include the steps of reversing the first and second templates; aligning the first and second templates over a second eyebrow forming a modified perimeter; marking the eyebrow within a modified perimeter with a coloring agent; removing the template from the eyebrow leaving the colored, shaped eyebrow; and removing excess hair outside of the colored, shaped eyebrow. Depending on the coloring agent used, the eyebrow may need to be brushed to bring forth the full, desired color.

By employing this method, the shape of the modified perimeter is chosen based on the individual's facial structure. For example, rounder faces should have a more arched and angular brow shape. Individuals with sharper features should have more rounded brows. Additionally, individuals with longer faces should have flatter brows, whereas those with wider faces should have a higher and more centrally placed arch. In determining brow shape, one should only not take into account face shape, but an individual's eyes, nose, lips/mouth, and cheekbones in order to achieve an ideal look.

Once the shape of the brow to be is determined, the template is placed over the brow and a coloring agent is used to outline and fill in the modified brow shape. This can be permanent or can be washed out depending on the individual's preference. The prime purpose of this step is to denote the area outside of the modified area that may require excess eyebrow hair removal or areas that need to be artificially filled in. Any excess hair may be removed by methods well known in the art such as by using creams, tweezers, waxes, lasers, and threads. Once the first brow is marked, the second brow is marked using the same template and simply reversing the templates. In some instances, alignment indicia are used to realign the templates. The fit between the two templates should prevent any movement from occurring during this process, thereby creating symmetrically shaped eyebrows every time.

In general, the present invention succeeds in conferring the following, and others not mentioned, benefits and objectives.

It is an object of the present invention to provide an adjustable eyebrow template that is lightweight and flexible.

It is an object of the present invention to provide an adjustable eyebrow template that is reversible.

It is an object of the present invention to provide an adjustable eyebrow template that provides for a wide variety of eyebrow shapes and sizes.

It is an object of the present invention to provide an adjustable eyebrow template that quickly and easily creates symmetrical eyebrow shapes and sizes.

It is an object of the present invention to provide an adjustable eyebrow template that provides an eyebrow shape based on the facial structures of an individual.

It is yet another object of the present invention to provide an adjustable eyebrow template that can be used by males and females.

It is yet another object of the present invention to provide an adjustable eyebrow template that can be used solely by an individual without compromising the results.

It is another object of the present invention to provide an adjustable eyebrow template that is inexpensive.

DETAILED DESCRIPTION OF THE INVENTION

Figure 1A:
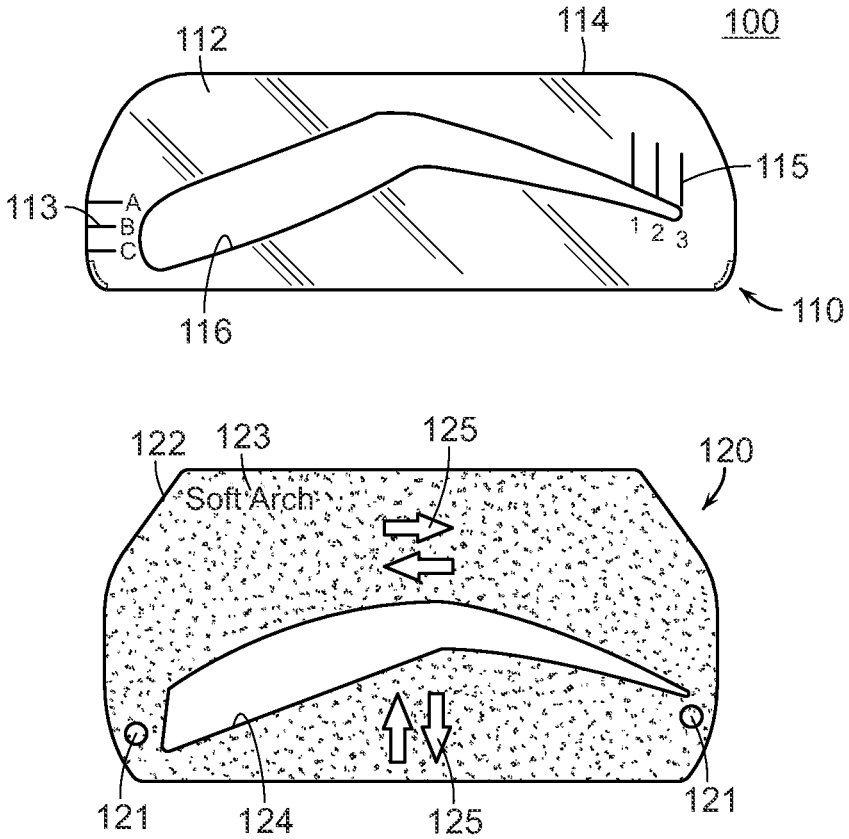
FIG. 1A is a front view of the first and second template of the present invention.

The preferred embodiments of the present invention will now be described with reference to the drawings. Identical elements in the various figures are identified, as far as possible, with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Figure 1B:
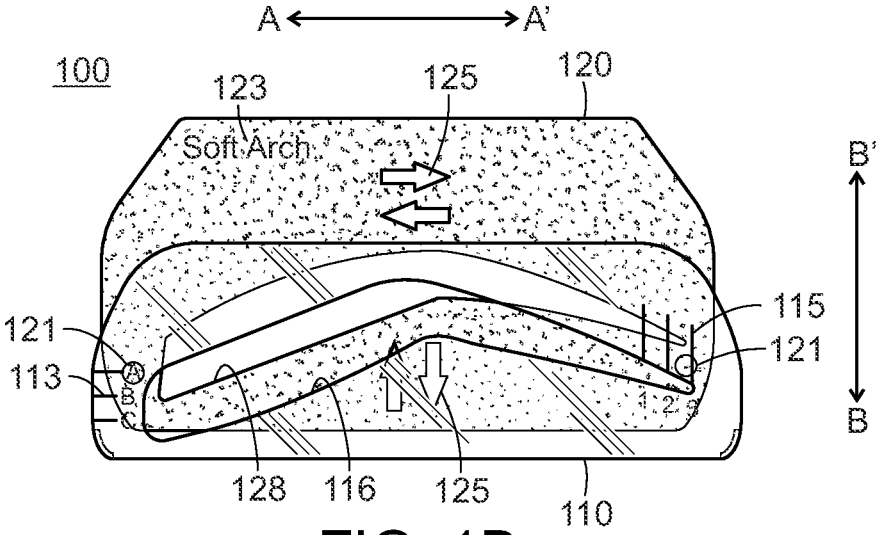
FIG. 1B is a front view of the first and second template combined as intended in accordance with the present invention.

Referring to FIGS. 1A and 1B, there is a first template 110 and a second template 120 which together form an adjustable eyebrow template 100. The first template 110 is defined by an upper surface 112 and a lower surface 118 (see FIG. 2) having a first outer perimeter 114 and a first inner perimeter 116. The two surfaces bear a substantially similar, if not identical, shape. The first inner perimeter 116 bears a shape that resembles an eyebrow.

Further, the first template 110 may have any number of first alignment indicia such as a height alignment indicia 113 or a width alignment indicia 115. The height alignment indicia 113 and width alignment indicia 115 are used to align the second template 120 with the first template 110. This creates an identifiable shape and size to be used for both eyebrows and for returning customers.

The second template 120 has a second outer perimeter 122 and a second inner perimeter 124 and is a unitary piece of material. The second template 120 has a second alignment indicia 121. The second alignment indicia 121 are used for positioning purposes. The first template 110 is preferably translucent or transparent thereby enabling the height alignment indicia 113 and width alignment indicia 115 to be aligned with the second alignment indicia 121 of the second template 120. To ensure proper template selection, the second template 120 may have an identifying indicia 123.

The second template 120 is sized to fit within the slot(s) 126 (see FIG. 2) of the first template 110. The second inner perimeter 124 bears a similar shape to the first inner perimeter 114. However, the second inner perimeter 124 is preferably smaller but in some instances may be larger than that of the first inner perimeter 116. The shape of the first template 110 and the second template 120 allows the second template 120 to be slid within the first template 110, thereby changing the shape of the first inner perimeter 114 with the second inner perimeter 124. The directional indicators 125 indicate the manner in which the second template 120 may be manipulated as shown in FIG. 1B.

In FIG. 1B, the first template 110 and the second template 120 have been combined with the second template 120 being slidably engaged to the first template 110. The second template 120 can be moved vertically along path B-B' and horizontally along path A-A'. This allows a part of the second inner perimeter 124 to extend within the bounds of the first inner perimeter 114 forming a modified perimeter 128.

The translucency or transparency of the first template 110 is clearly shown as the second alignment indicators 121 can be seen to be aligned with the height alignment indicators 113 and the width alignment indicators 115.

The modified perimeter 128 still bears the shape of an eyebrow, but rather than a being general brow shape, it is a tailored, custom shape intended for use on a particular person. Some desired eyebrow shapes may require a third or more templates, similar to that of the second template 120, to further achieve a particular look. Alternatively, the second template 120 may be placed in one configuration and then placed into a second configuration in relation to the first template 110. Through these various configurations and shaped templates, virtually any shaped modified perimeter 128 is achievable.

Figure 2:
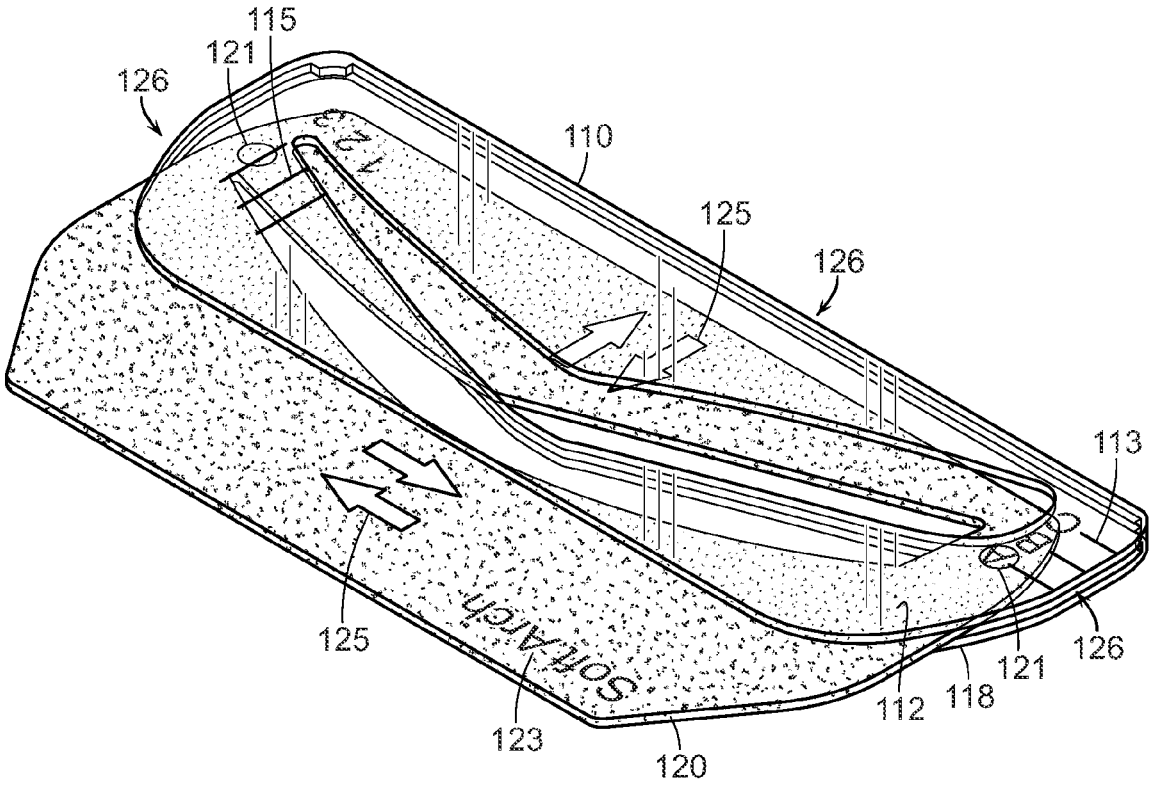
FIG. 2 is a perspective side view of two combined templates of the present invention.

Referring now to FIG. 2, the relationship between the two templates is visible as to how the second template 120 fits within the first template 110. The upper surface 112 and the lower surface 118 of the first template 110 are clearly shown. The upper surface 112 and lower surface 118 are separated by a limited distance.

This narrow gap between the upper surface 112 and the lower surface 118 forms at least one slot 126 along the lateral edges of the first template 110. The number of slots 126 may vary with the number of lateral edges in the eyebrow template 100 structure. For example, if there are four edges there can be anywhere from one to four slots 126. Preferably, there is at least one slot 126. If there is only one slot 126, it stands to reason that the remaining edges are comprised of vertical walls between the two surfaces. If there are two slots 126, then there is one less vertical wall.

The gap between the upper surface 112 and the lower surface 118 should be of a width that permits the second template 120 to fit within the gap. It would be desirable to have a gap that is of a thickness or slightly larger than that the second template 120, to enable the second template to be frictionally held in place once positioned. This prevents the second template 120 from falling out, shifting, or requiring external support. In some instances, low tack adhesives or clip structures may be used to help solidify this interaction.

Figure 3A:
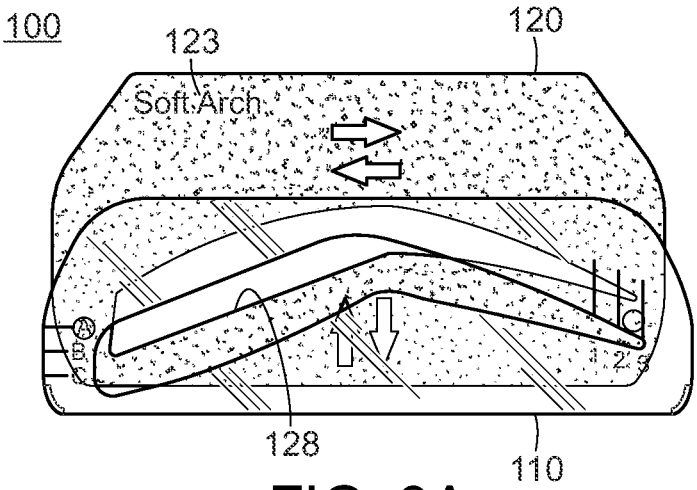
FIG. 3A is a front view of the present invention illustrating an example of a soft eyebrow arch.
Figure 3B:
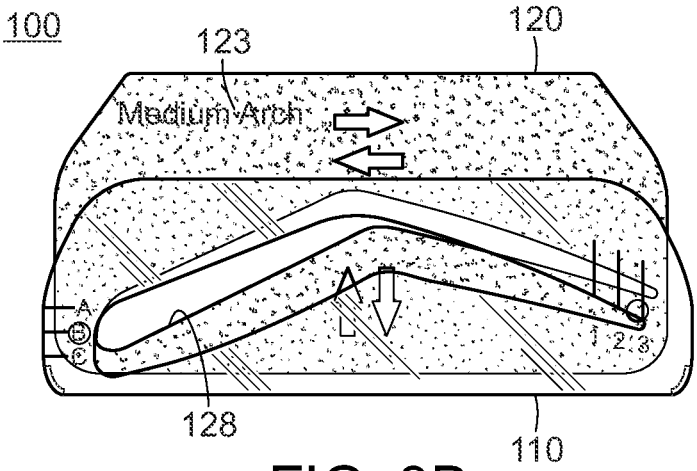
FIG. 3B is a front view of the present invention illustrating an example of a medium eyebrow arch.
Figure 3C:
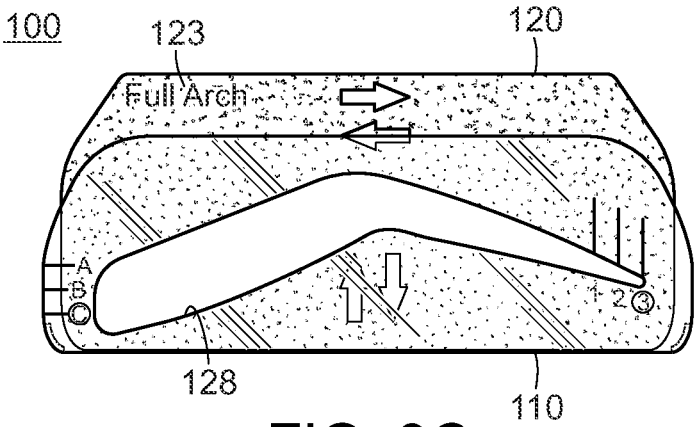
FIG. 3C is a front view of the present invention illustrating an example of a full eyebrow arch.

FIGS. 3A-C show different configurations of the modified perimeter 128 of the adjustable eyebrow template 100. The configurations shown are intended to be illustrative and virtually any variation thereof may be feasible. In FIG. 3A, the second template 120 is positioned such that it is overlaid by the first template 110. The second template 120 is positioned to create modified perimeter 128. The modified perimeter 128 creates a "soft arch" as indicated by the identifying indicia 123. In FIG. 3B, the second template 120 is positioned in much the same manner as the templates in FIG. 3A. However, the identifying indicia 123 indicates the second template 120 should provide for a modified perimeter 128 with a "medium arch." In FIG. 3C, the second template 120 has been positioned within the first template 110 with the second template 120 being identified by the identifying indicia 123 as having a modified perimeter 128 with a "full arch."

In each of FIGS. 3A-C, the modified perimeter 128 can be modified in a number of ways. The eyebrow can be modified in a singular fashion such as thickness, thinness, width, or length. The modified perimeter 128 may shorten the end of the brow closest to the nose or alternatively towards the tip of the brow. The modified perimeter 128 may use the second template 120 to decrease the thickness of the brow from either the top or bottom of the modified perimeter 128.

Modifying the underside of the brow is going to create a more arched and higher brow, whereas modifying the topside of the brow is going to create a lower, flatter brow. Additionally, the modified perimeter 128 may modify multiple aspects of the brow simultaneously. The first template 110 allows independent movement of the second template 120 within the first template 110. This not only allows a lateral motion (i.e. sliding in and out of the slot) but additionally up/down or side/side movement (based on slot position).

Thus, the second template 120 can both thin and shorten a brow at the same time. The second template 120 can also be shifted upwards to narrow the brow from underneath. Such adjustments are typically made by holding the first template 110 stationary and manipulating the second template 120 into the desired position. Some individuals may find it easier to reverse the process and to adjust the first template 110 while the second template 120 is inserted therein.

Figure 4:
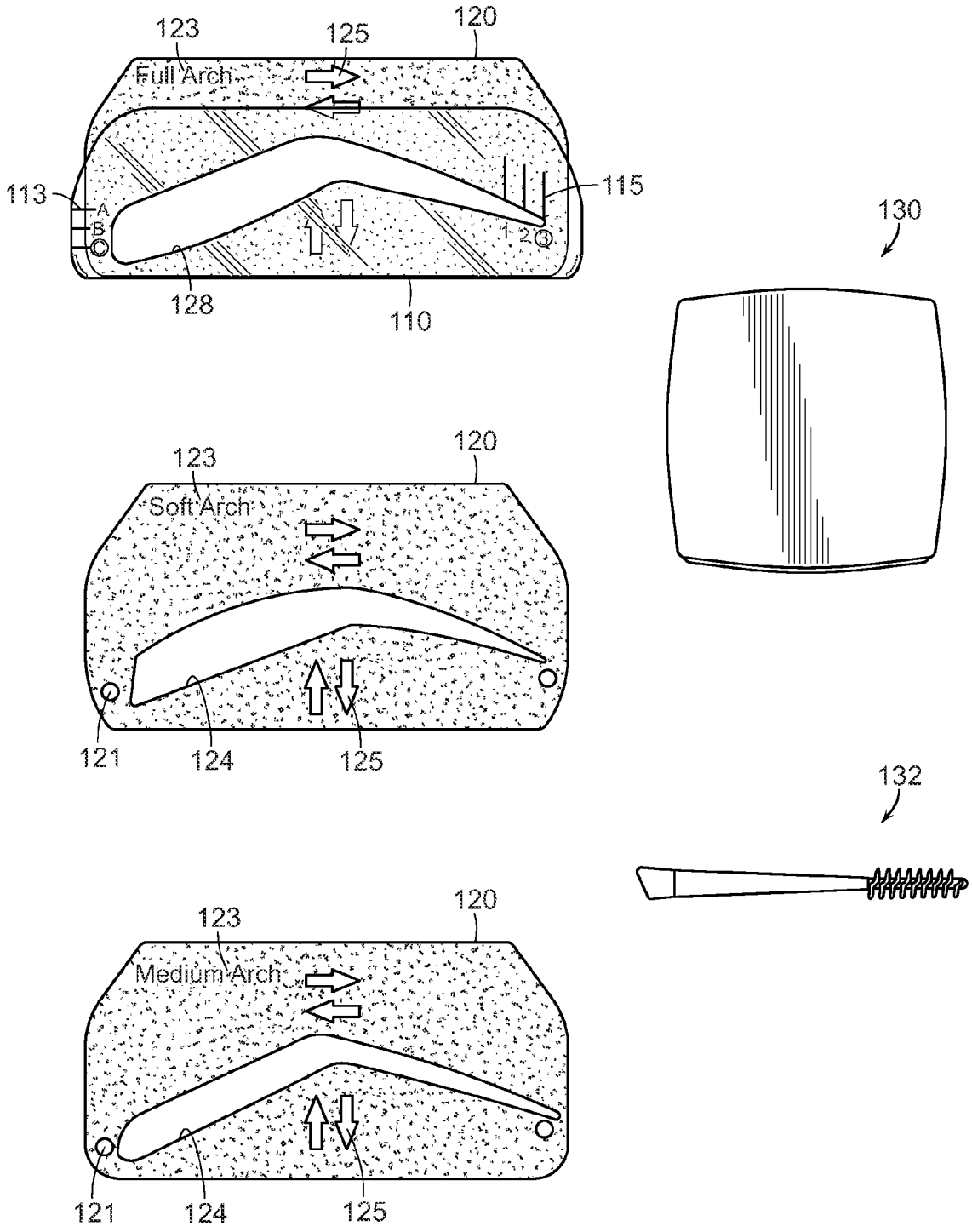
FIG. 4 is a front view of a kit of the present invention.

Referring now to FIG. 4, there is a typical kit containing the required for marking, shaping, and modifying an eyebrow shape in accordance with the present invention and its embodiments. There is at least one first template 110 and at least one, preferably three, second templates 120. The templates are marked with identifying indicia 123 to identify the general type or style of arch to be applied. Directional indicators 125 provide visual cues for movement of the templates. First alignment indicators, notably the height alignment indicators 113 and width alignment indicators 115, are used in conjunction with the second alignment indicators 121 to ensure proper alignment of the templates from eyebrow to eyebrow and in future use scenarios.

In addition to the templates, there is a coloring agent 130 and a brush 132. The coloring agent 130 is intended to be applied to the eyebrow once the templates have been positioned and a modified eyebrow shape has been established. The coloring agent 130 is then applied to this modified area. The coloring agent 130, when applied, produces a color that contrasts the color of the recipient's eyebrows. This provides a clear indication as to which eyebrow hair should be removed and which should remain.

Once the eyebrow hairs have been removed, the brush 132 is used to brush through the eyebrows. The brushing causes the coloring agent 132 to change color from a color that contrasted with the recipient's eyebrows to a color that matches their eyebrow color seamlessly.

Figure 5:
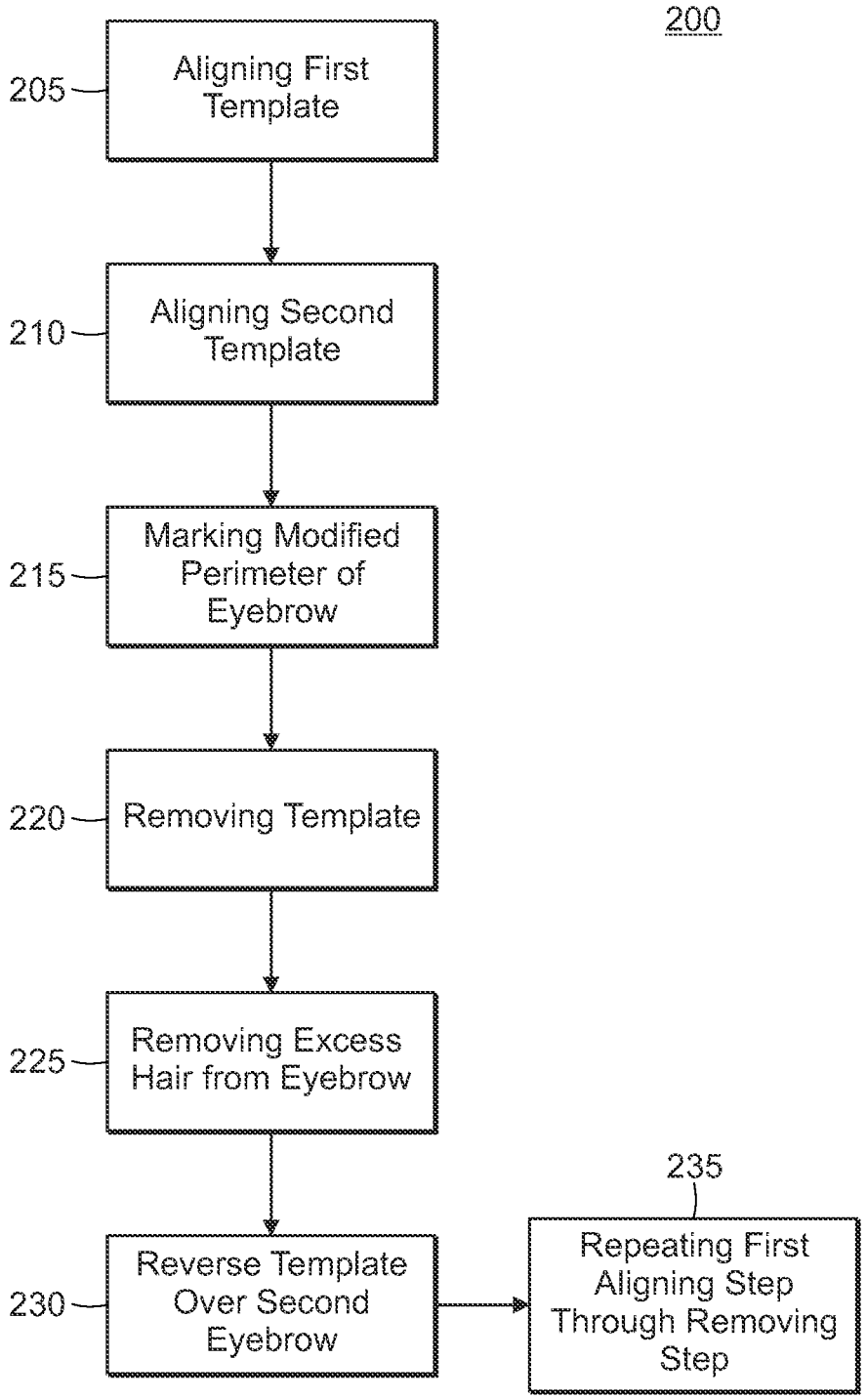
FIG. 5 is a flowchart illustrating a method of using the present invention.

In FIG. 5, there is a flow chart illustrating the methodology for using the current invention in one intended usage. The method 200 of shaping an eyebrow with an adjustable eyebrow template begins with aligning the first template in step 205. The first template should be aligned over the eyebrow. Preferably, the first inner perimeter should essentially encompass the entire eyebrow. Alternatively, the second template may be positioned within the first template before placing it over the eyebrow of the recipient. Some individuals may have larger or unkept brows and as such their brow may be larger than the inner perimeter of the first template. The first inner perimeter is generally shaped to provide a large enough perimeter for a starting point in the shaping/coloring process. In some cases, there may be different stock sizes of first templates with varying first inner perimeters.

The second template is then aligned, in step 210, by sliding the second template into a slot of the first template. This does not necessarily need to be performed over the physical eyebrow in question. The adjustable eyebrow template may be placed over a photograph or a screen or another representation of the eyebrow to be treated. The templates can then be manipulated from there. Additionally, the eyebrow may be preshaped through a photo editing software or the like. The adjustable eyebrow template can then be placed over, for example, the presized print out or photograph.

Once the templates and modified perimeter is set, the new shape of the eyebrow can be marked in step 215. The modified perimeter is marked with any type of marking apparatus such as a coloring agent, of which any coloring or other type of designating mark can be permanent or temporary depending on the individual's choice. For example, the coloring agent may be applied and appear white or another suitable color to vividly contrast with the recipient's eyebrow color.

Once the new modified perimeter of the brow is successfully marked, the templates are removed in step 220. The remaining brow should now bear the color or marking used to designate the modified perimeter. Some part(s) of the brow may not have been included in the modified perimeter.

In such a case, the excess eyebrow hair, residing outside the modified perimeter, may need to be removed in step 225. This is done by any variety of hair removal processes known in the art including creams, waxing, lasers, tweezers, or the like. The eyebrow in question should now be complete and have the desired look. The coloring agent can then be removed or brushed through thereby changing the color match the recipient's eyebrow color.

The templates can then be reversed, in step 230 and placed over the second eyebrow. The same process is repeated involving the marking through removal steps described above as shown in step 235.

The adjustable eyebrow template 100 shown in FIGS. 1-3C should be appropriately sized for positioning on a human face while allowing the templates to fit the curvature of the individual without undue interference from other body parts (i.e. nose). The first template 110 should be about 3.8 cm (1.5 inch) to about 11.5 cm (4.5 inch) wide, preferably being about 8.6 cm (3.38 inch) wide. The first template should be about 2.5 cm (1 inch) to about 10 cm (4 inch) in height and preferably be about 2.9 cm (1.13 inch) in height. The first inner perimeter 116 should generally form an eyebrow shape having an inner corner (near the eye), a length, an arch height, and a tail (end away from eye). The inner perimeter 116 should generally encompass most any eyebrow shape. Thus, the inner perimeter 116 may be between about 2.5 cm (1 inch) and about 7.5 cm (3 inch) in length and of a varying diameter from about 0.6 cm (0.25 inch) to about 3.8 cm (1.5 inch).

The second template 120 should be sized to engage the first template 110. The exact dimensions of the second template 120 can vary due to the requirement the second template 120 moves within the slot(s) 126 creating more unique styles. However, the second template may have a width of about 3.8 cm (1.5 inch) to about 11.5 cm (4.5 inch). The height of the second template 120 may be about 2.5 cm (1 inch) to about 10 cm (4 inch) in height. Additionally, the second inner perimeter 124 should be sized based on the size of the first inner perimeter 116 and preferably the second inner perimeter 124 should be smaller than the first inner perimeter 116.

The adjustable eyebrow template 100 is preferably formed from a thin, flexible plastic. However, suitable other materials may include resins, composites, and coated metals. In some instances, the templates are translucent in color which permits one to see the placement of each of the templates when overlaid. The templates may be flat or may have a curvature to them designed to sit on the facial structure of a human. If they are not flat the flexible composition may permit the templates to be pressed flat without causing discomfort or damaging the templates.

What is claimed is:

1. An adjustable eyebrow template for defining and coloring a desired shape of an eyebrow comprising:

a transparent first template having an upper surface and a lower surface, the upper surface being coupled to the lower surface forming at least one slot between the upper surface and the lower surface, wherein the upper surface has a first outer perimeter and a first inner perimeter defining an opening there through, wherein the lower surface has an identical inner perimeter and an identical opening there through as the upper surface, wherein the upper surface has at least one first alignment indicia;

a second template having a second outer perimeter and a second inner perimeter defining an opening there through, wherein the second template has at least one second alignment indicia, wherein the second inner perimeter is similar in shape to the first inner perimeter of the transparent first template; and the first inner perimeter and the second inner perimeter substantially correspond to the shape of an eyebrow wherein the second template is removably coupled to the first template by insertion of the second template into the at least one slot of the first template such that the second template may slide vertically and/or horizontally within the at least one slot to align the at least one first and second alignment indicia; wherein when the first and second templates are coupled and the at least one second alignment indicia is aligned with the at least one first alignment indicia, a portion of the second inner perimeter is disposed within the opening defined by the first inner perimeter to define a modified inner perimeter bound by portions of the first and second inner perimeters, where the modified inner perimeter forms a shape of an eyebrow.

2. The adjustable eyebrow template of claim 1 wherein the inner perimeter of the second template is smaller than the first inner perimeter of the transparent first template.

3. An adjustable eyebrow template for defining and coloring a desired shape of an eyebrow comprising:

a transparent first template having an upper surface and a lower surface, the upper surface being coupled to the lower surface forming at least one slot therebetween, wherein the upper surface and the lower surface have identical openings there through defining a identical first inner perimeters, wherein the upper surface has at least two sets of first alignment indicia;

a second template having a second outer perimeter and an opening there though defining a second inner perimeter, wherein the second template has two second alignment indicia;

wherein the second inner perimeter and the first inner perimeters of the transparent first template are similar in shape and substantially correspond to the shape of an eyebrow, wherein the two sets of first alignment indicia and the two second alignment indicia are positioned proximate to an inner corner which corresponds to a medial portion of the eyebrow shape and a tail which corresponds to a lateral portion of the eyebrow shape; and wherein the second template is removably coupled to the first template by insertion of the second template into the at least one slot of the first template such that the second template may slide vertically and/or horizontally within the at least one slot to align at least one of the at least two sets of first alignment indicia with at least one of the two second alignment indicia; wherein when the first and second templates are coupled and at least one of the two second alignment indicia is aligned with at least one of the at least two sets of first alignment indicia, a portion of the second inner perimeter is disposed within the opening defined by one of the first inner perimeters to define a modified inner perimeter bound by portions of the second inner perimeter and the one of the first inner perimeters, where the modified inner perimeter forms a shape of an eyebrow.

4. The adjustable eyebrow template of claim 3 further comprising at least one identifying indicia on the transparent first template, second template, or a combination thereof, wherein the at least one identifying indicia identifies the general shape or style of the eyebrow arch provided thereby.

5. The adjustable eyebrow template of claim 3 wherein the at least two sets of first alignment indicia comprise one set of indicia indicating particular heights and another set of indicia indicating particular widths.

6. The adjustable eyebrow template of claim 3 further comprising directional indicators disposed on the second template.

7. An eyebrow treatment kit comprising:

at least one coloring agent;

at least one brush;

at least one transparent first template having an upper surface and a lower surface, the upper surface being coupled to the lower surface forming at least one slot therebetween, wherein the upper surface and the lower surface have identical openings there through defining identical first inner perimeters in substantially the shape of an eyebrow, wherein the upper surface has at least two sets of first alignment indicia;

at least one second template having a second inner perimeter in substantially the shape of an eyebrow, wherein the second inner perimeter is similar in shape to the first inner perimeters of the at least one transparent first template, wherein the at least one second template has two second alignment indicia, wherein the two sets of first alignment indicia and the two second alignment indicia are positioned proximate to an inner corner which corresponds to a medial portion of the eyebrow shape and a tail which corresponds to a lateral portion of the eyebrow shape, wherein the at least one second template is removably coupled to the at least one first template by insertion of the at least one second template into the at least one slot of the at least one first template such that the at least one second template may slide vertically and/or horizontally within the at least one slot to align at least one of the at least two sets of first alignment indicia with one of the two second alignment indicia; wherein when the at least one first and second templates are coupled and at least one of the two second alignment indicia is aligned with at least one of the at least two sets of first alignment indicia, a portion of the second inner perimeter is disposed within the opening defined by one of the first inner perimeters to define a modified inner perimeter bound by portions of the second inner perimeter and the one of the first inner perimeters, where the modified inner perimeter forms a shape of an eyebrow.

8. The eyebrow treatment kit of claim 7 wherein there are three second templates each having a different sized inner perimeter.

* * * * *